United States Patent [19]

Norlin et al.

[11] 3,982,508

[45] Sept. 28, 1976

[54] SPEED REGULATORS FOR INTERNAL COMBUSTION ENGINES, PARTICULARLY DIESEL ENGINES, IN EARTH MOVERS AND WORKERS

[75] Inventors: Bertil Norlin; Karl Oscar Olsson, both of Eslov, Sweden

[73] Assignee: Akermans Verkstad AB, Eslov, Sweden

[22] Filed: Jan. 21, 1975

[21] Appl. No.: 542,809

[30] Foreign Application Priority Data

Jan. 23, 1974 Sweden ..... 7400846

[52] U.S. Cl. ..... 123/97 R; 123/98

[51] Int. Cl.[2] ..... F02D 11/02

[58] Field of Search ..... 123/97 R, 104, 98; 172/7, 663, 803, 804, 809

[56] References Cited

UNITED STATES PATENTS

| | | | |
|---|---|---|---|
| 3,360,052 | 12/1967 | Johansen | 172/7 |
| 3,692,007 | 9/1972 | Nilssen | 123/98 |
| 3,753,467 | 8/1973 | Wilson | 172/7 |

*Primary Examiner*—Charles J. Myhre
*Assistant Examiner*—William C. Anderson
*Attorney, Agent, or Firm*—Blair & Brown

[57] ABSTRACT

A speed regulator for an engine of an earth mover and worker, particularly a diesel engine of an excavator, said speed regulator including an operating member which comprises a piston and cylinder unit and is connected into the linkage between the fuel supply regulating means of the engine and a manually operable lever, the feed and outlet lines of the piston cylinder unit being coupled to a control circuit which is connected to the operating system for the implements of the earth mover and worker.

6 Claims, 3 Drawing Figures

SPEED REGULATORS FOR INTERNAL COMBUSTION ENGINES, PARTICULARLY DIESEL ENGINES, IN EARTH MOVERS AND WORKERS

The invention relates to a speed regulator for use in internal combustion engines, particularly diesel engines, of earth movers and workers, including an operating member connected to the fuel control means of the engine for the actuation thereof, said operating member being a piston and cylinder unit which is connected into the linkage between the fuel control means and a manually operable lever.

A diesel engine normally has a regulator by which to control, via a lever of the fuel injection pump, the amount of fuel supplied to the combustion chamber of the engine to drive said engine at a definite speed. In an excavator the engine is usually placed in the rear part of the rotary machine superstructure, while the operator has his seat in a separate cabin in the front part of the superstructure, for which reason said speed regulation is effected from the driver's seat by means of a lever which via a linkage mechanically transmits movements to the lever of the fuel injection pump. During the excavating work the engine shall operate at full speed to be able to provide full power output. Before commencing the excavating work the operator adjusts his regulator lever at full speed, the so-called racing speed. The racing speed is somewhat higher than the full-load speed because the engine is on the whole under no load. As soon as the operator actuates his controls to perform excavating work the amount of fuel injected is automatically increased or reduced, and when the engine is placed under load the engine speed sinks to a value slightly below the racing speed. If the operator wishes to regulate the engine speed this must be done by means of the regulator lever for actuation of the fuel injection pump lever.

The fuel consumption highly varies and of course is dependent upon the output required. In most machines of this type the engine drives the hydraulic pumps coupled to the engine. The operator, when necessary, can change the speed by means of the regulator lever but this cannot be done at the same time as he operates the machine for excavation; therefore he must cease excavating under movement for the duration of the speed regulation. In a working-day the operator has to effect a great many speed regulations, which is a tiresome and time-consuming work.

The speed regulation device comprises two limit positions, on the one hand, the so-called racing speed position which gives the maximum speed and, on the other hand, the so-called idle running position, which gives the minimum speed.

At the idle running speed the fuel consumption is approx. 1/6 to ⅛ of the fuel consumption at the racing speed, and a reduction of the fuel consumption would of course be attained if a speed lower than the racing speed could be maintained. Besides, the noise level of the machine would be reduced considerably, if this could be done.

The object of the present invention is to overcome the disadvantages outlined in the foregoing and to provide an automatically operating, fuel-saving and noise level reducing speed regulation of the engine.

To this end, the feed and outlet lines of the piston and cylinder unit are coupled to a control circuit which is connected to the control system of the implements of the earth mover.

Embodiments of the invention will be more fully described hereinbelow and with reference to the accompanying drawings in which.

Figure 1:
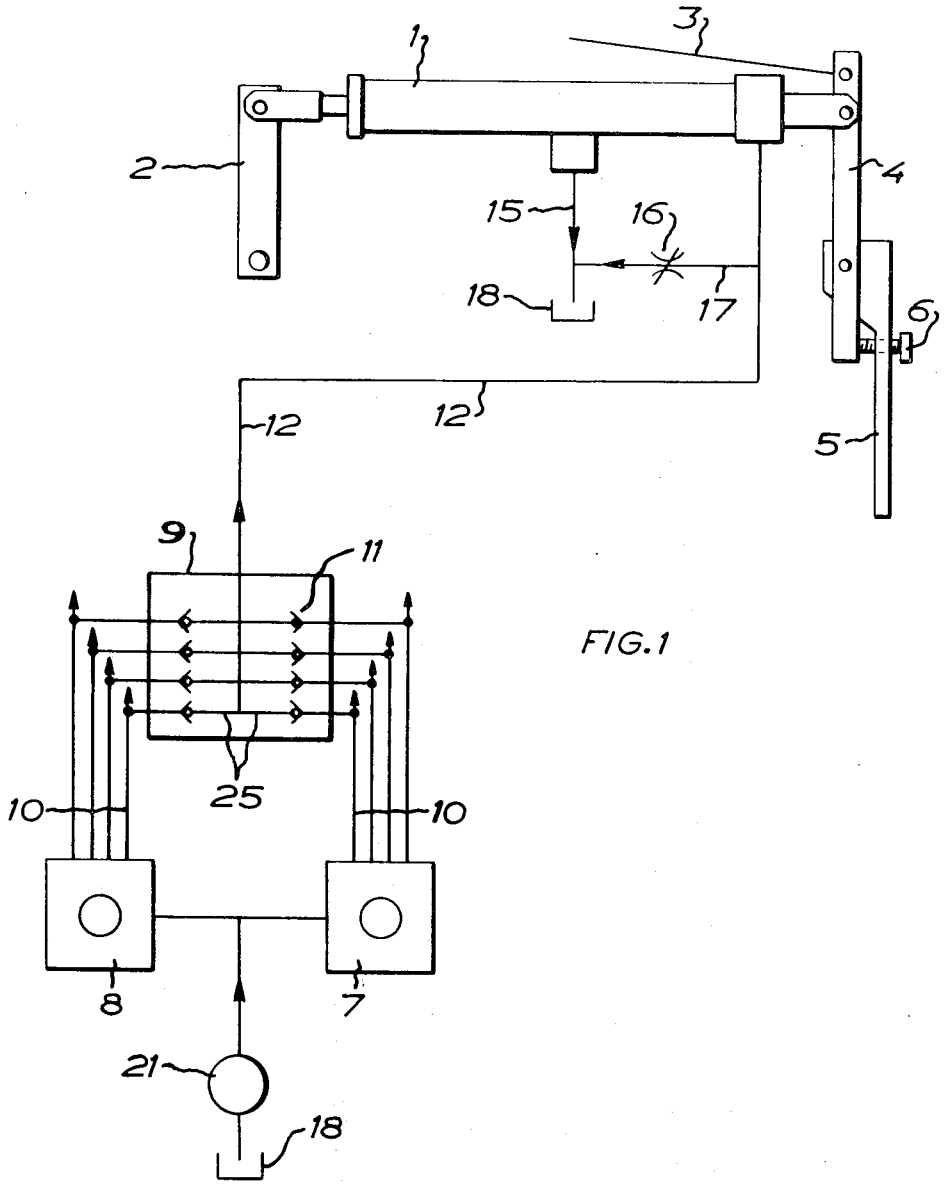
FIG. 1 shows an embodiment of the invention, partly in the form of an hydraulic coupling diagram.

In the drawings, 1 denotes a hydraulic unit one end of which is fixed to a control lever 2 connected to the fuel injection pump of a diesel engine. The hydraulic unit can preferably be fixed to different points of the lever to permit adjustment of the length of the lever, according to need. The other end of the hydraulic unit 1 is attached to a control rod 4, which is mounted at its lower end. A link or wire rope 3 is connected to the upper end of said rod 4, while the other end of said link or wire rope is connected to a regulator lever at the driver's seat. The control rod 4 is mounted to a bracket 5 attached to the engine. If the hydraulic unit 1 occupies a definite position, the rod 4 and thus the lever 2 of the fuel injection pump can be tilted, as will appear from FIG. 1, by actuation of the link or wire rope 3 between a position to the far left in FIG. 1 in which position the engine operates at idle running speed, and a position to the far right in which the engine runs at racing speed. Adjustment of the idle running speed and the racing speed is made on the fuel injection pump.

Figure 2:
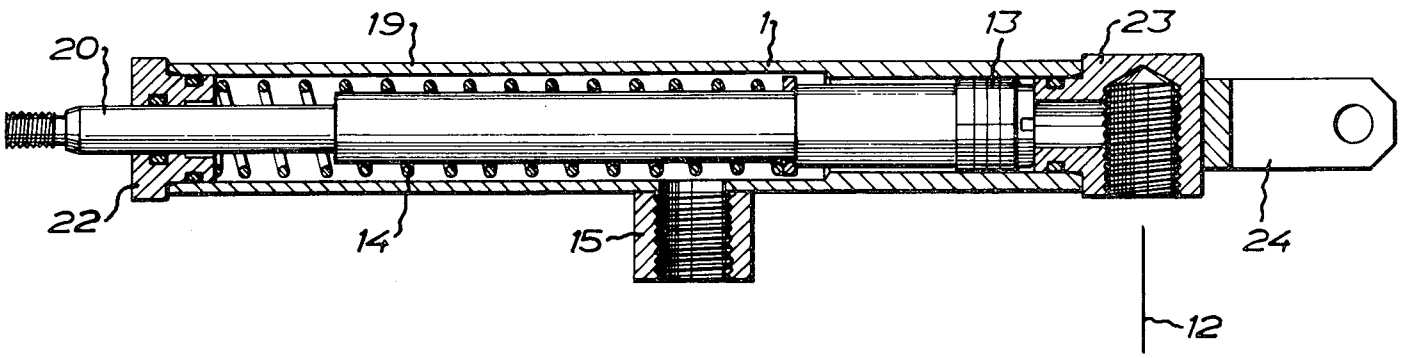
FIG. 2 shows a section of a hydraulic unit indicated in FIG. 1.

The hydraulic unit 1 is shown in section in FIG. 2 and comprises a tubular jacket 19 having end pieces 22, 23. A piston 13 is reciprocable in said tubular jacket 19 and connected with the lever 2 of the fuel injection pump by means of a piston rod 20 which extends through an opening in one 22 of said end pieces. The opposite end piece 23 has a lug 24 which is connected to the rod 4. A pressure spring 14 is wound about the piston rod 20 and, when no hydraulic pressure prevails, said spring urges the piston 13 to an extreme position in which the piston rod 20 is retracted to the highest possible extent into the tubular jacket 19.

A feed line 12 is connected to the hydraulic unit 1 for the operation thereof. Said feed line leads to a collecting box 9 in which it branches into eight branch conduits 25 each having a non-return valve 11, as will be apparent from FIG. 1. These branch conduits 25 are connected each to one of the pipe lines 10 which extend between the valve arrangement connected to the control levers 7, 8 for controlling the working movements of the excavator, and the devices for producing the working movements of the excavator. For producing a working movement either of the control levers 7, 8 is actuated in conventional manner to connect the associated line 10 to the pump 21, the branch conduit 25 coupled to said line 10 being simultaneously placed under pressure as is the feed line 12. An outlet 15 leading to a tank 18 is also connected to the hydraulic unit 1. A drain line 17 having a throttle valve 16 is coupled between the feed line 12 and the outlet 15 to discharge pressure fluid acting upon the piston via the line 12 when the communication between the lines 10 and the pump 21 is interrupted by the control levers or either control lever being brought to neutral position. As an alternative, the construction may be such that the pressure fluid acting upon the piston is discharged via a suitably dimensioned gap surrounding the piston, in which case the drain line 17 and the throttle valve 16 can be dispensed with.

The system described operates in the following way. After the engine speed has been increased to the off-load speed preset by means of the screw 6, excavating work can commence by actuation of either or both control levers 7, 8, since pressure fluid is supplied to the feed line 12 at the very moment when a working movement is commenced, in that one or more lines 10 are connected with the pump 21, whereby the piston 13 is moved against the action of the spring 14 and the hydraulic unit 1 is extended. This will tilt the lever 2 of the fuel injection pump to the right as viewed in FIG. 1, and the engine speed will increase. At the same moment as the pressure in the line or lines 10 is equalised the pressure is equalised in the feed line 12, whereby the piston 13 begins to return to the position of rest under the action of the spring 14, the pressure fluid being drained to the tank 18 via the line 17 and the throttle valve 16. The lever 2 of the fuel injection pump is caused by the hydraulic unit 1 to move very rapidly to the racing speed position, while it returns, if desired, considerably more slowly to the idle running speed position by adjustment of throttle valve 16.

Figure 3:
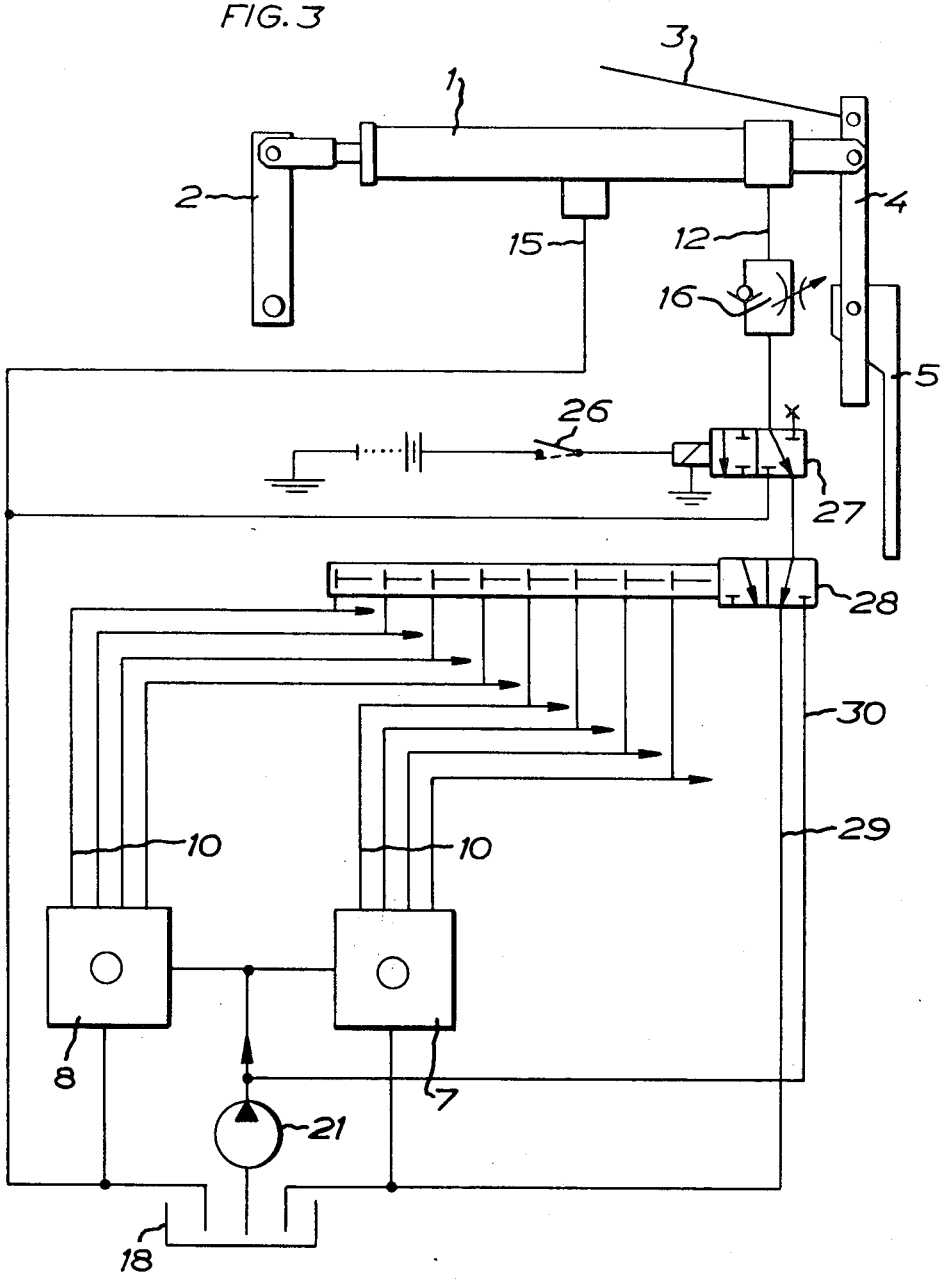
FIG. 3 shows a modified embodiment corresponding to FIG. 1.

FIG. 3 shows an embodiment in which a modified control of the hydraulic unit is applied. In this Figure, the parts corresponding to those shown in FIG. 1 bear the same reference numerals.

For operation of the hydraulic unit 1 a feed line 12 is connected to said unit (FIG. 3), said feed line extending to a throttle non-return valve 16 and from there to a solenoid valve 27. The feed line passes through a control valve 28 and, in dependence on the position set for the control valve, it can be connected either to a tank line 29 or to a pump line 30. Lines 10, which extend between the control levers 7, 8 for regulating the working movements of the excavator, are all branched off to the operating portion of the control valve 28. For producing a working movement either or both control levers 7, 8 are actuated in conventional manner so that the associated line 10 is connected to a pump 21, and the branch conduit leading to the control valve 20 and connected to said line 10 is simultaneously placed under pressure, actuating the control valve 28, so that the pump pressure in the line 30 actuates the hydraulic unit 1 via the control valve, the solenoid valve 27, the throttle non-return valve 16 and the feed line 12. A leakage conduit 15 leading to the tank 18 is also connected to the hydraulic unit 1. When the control levers 7 and 8 are returned to neutral position the control valve 28 returns to the position shown in FIG. 3 and connects the hydraulic unit with the tank line 29 via the solenoid valve 27 and the throttle non-return valve 16. With the aid of the spring 14 the piston 13 is returned to its lower position when the pressure fluid is led away through the throttle non-return valve 16.

At manual speed regulation a switch 26 is closed and the hydraulic unit is released from the remaining hydraulic system by means of the solenoid valve 28 which connects the hydraulic unit with the tank 18. The engine can be regulated within its entire speed range by means of the gas control lever 3.

It will be realized that regulation of the speed in the present instance can take place either manually or automatically, the automatic regulation taking place between an adjustable lower value within the range delimited by the idle running speed and the maximum off-load speed, and an adjustable upper valve within the range delimited by the speed corresponding to ¾ output and the racing speed.

What we claim and desire to secure by Letters Patent is:

1. An automatic speed regulator for the internal combustion engine of an earth moving machine or the like of the type having at least one hydraulically operated implement, a source of hydraulic fluid under pressure, an hydraulic pressure line connected to said implement, the means to selectively supply hydraulic fluid under pressure to said implement through said pressure line, a manually operable fuel control linkage whereby the speed of said engine may be controlled by controlling the fuel to said engine, a fuel control means the novelty comprising connecting means connecting said fuel control linkage to said fuel control means, said connecting means including extensible and retractable means, means to constantly bias said extensible and retractable means in one direction to reduce the flow of fuel to said engine to reduce the speed thereof, said extensible and retractable means including hydraulic means for biasing said extensible and retractable means to overcome the bias of said means to constantly bias said extensible and retractable means, said hydraulic means being connected to said source of hydraulic liquid under pressure when said hydraulically operated implement is supplied with fluid under pressure to operate it, and drain means for said extensible and retractable means so constructed and arranged that when fluid under pressure is not supplied to said implement, said extensible and retractable means will be biased by said means to constantly bias said extensible and retractable means to reduce the flow of fuel to said engine in order to reduce the speed thereof.

2. The speed regulator of claim 1 in which a nonreturn valve is provided in said hydraulic pressure line to said implement.

3. The speed regulator of claim 2 in which a plurality of implements are provided each with a hydraulic pressure line connected to said extensible and retractable means and each hydraulic pressure line is provided with a non-return valve.

4. The speed regulator of claim 3 in which each said extensible and retractable element is a piston and cylinder means constantly biased in one direction by a spring.

5. The speed regulator of claim 3 including a control valve in which said hydraulic connection to said extensible and retractable means is connected to said control valve the operating portion of which is connected by branch conduits to the hydraulic lines to each of said implements, whereby the control valve is caused to connect the hydraulic connection to said extensible and retractable means to a source of hydraulic fluid under pressure when the hydraulic pressure line to an implement is placed under pressure, and to connect said hydraulic connection to a tank when no hydraulic pressure line to an implement is provided.

6. The speed regulator of claim 5 in which the fluid from said extensible and retractable means is drained through a throttling valve.

* * * * *